US012435572B2

(12) United States Patent
Peter et al.

(10) Patent No.: US 12,435,572 B2
(45) Date of Patent: Oct. 7, 2025

(54) DOWNHOLE COMPONENT HAVING A VARIABLE BENDING STIFFNESS

(71) Applicant: Baker Hughes Oilfield Operations LLC, Houston, TX (US)

(72) Inventors: Andreas Peter, Celle (DE); Volker Peters, Celle (DE); Christian Fulda, Sehnde (DE); Sven Krueger, Winsen (DE); Paul Madero, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/640,950

(22) Filed: Apr. 19, 2024

(65) Prior Publication Data

US 2024/0352799 A1 Oct. 24, 2024

Related U.S. Application Data

(60) Provisional application No. 63/461,081, filed on Apr. 21, 2023.

(51) Int. Cl.
*E21B 7/06* (2006.01)
*E21B 44/02* (2006.01)

(52) U.S. Cl.
CPC ..... *E21B 7/06* (2013.01); *E21B 44/02* (2013.01)

(58) Field of Classification Search
CPC ..... E21B 7/04; E21B 7/06; E21B 44/02
See application file for complete search history.

(56) References Cited

U.S. PATENT DOCUMENTS

| | | | | |
|---|---|---|---|---|
| 4,674,580 | A | 6/1987 | Schuh et al. | |
| 7,963,347 | B2 | 6/2011 | Pabon | |
| 9,243,453 | B2 | 1/2016 | Koch et al. | |
| 10,641,044 | B2 | 5/2020 | Sadabadi et al. | |
| 11,643,883 | B1 * | 5/2023 | Hardin | E21B 17/20 166/61 |

(Continued)

FOREIGN PATENT DOCUMENTS

| | | |
|---|---|---|
| EP | 4063050 A1 | 9/2022 |
| RU | 2734198 C1 | 10/2020 |

OTHER PUBLICATIONS

International Search Report and Written Opinion for International Application No. PCT/US2024/025391, International Filing Date Apr. 19, 2024, Date of Mailing Aug. 23, 2024, 8 pages.

(Continued)

*Primary Examiner* — Dany E Akakpo
(74) *Attorney, Agent, or Firm* — CANTOR COLBURN LLP

(57) ABSTRACT

A bending stiffness control system in a downhole drilling assembly includes a body configured to be connected to a downhole component of the downhole drilling assembly, the body having a longitudinal axis. The bending stiffness control system also includes a cavity disposed within the body and extending along the longitudinal axis, and a moveable element assembly including one or more moveable elements that are configured to move along the longitudinal axis, the moveable element assembly configured to control a bending stiffness of the body by reacting to a change in an inclination of the body and the longitudinal axis.

20 Claims, 4 Drawing Sheets

(56) References Cited

U.S. PATENT DOCUMENTS

| | | | | |
|---|---|---|---|---|
| 2008/0041582 | A1 | 2/2008 | Saetre et al. | |
| 2010/0133012 | A1 | 6/2010 | Howard et al. | |
| 2013/0341098 | A1 | 12/2013 | Perrin et al. | |
| 2017/0350192 | A1* | 12/2017 | Sadabadi | E21B 17/00 |
| 2019/0284882 | A1 | 9/2019 | Peters | |
| 2020/0018377 | A1 | 1/2020 | Hohl et al. | |
| 2021/0079738 | A1 | 3/2021 | Peters et al. | |
| 2021/0079976 | A1 | 3/2021 | Hohl et al. | |

OTHER PUBLICATIONS

Slavin, L. et al.; "The Effects of Pipe Stiffness on HDD Pull Loads"; Presentation for Pipelines Conference (2012) DOI: 10.1061/9780784412480.080.

* cited by examiner

DOWNHOLE COMPONENT HAVING A VARIABLE BENDING STIFFNESS

This application claims the benefit of U.S. Provisional Patent Application Ser. No. 63/461,081 filed Apr. 21, 2023.

BACKGROUND

In the resource recovery and fluid sequestration industry, various types of drill strings are deployed in a borehole for purposes such as exploration and production of hydrocarbons. A drill string generally includes drill pipe or other tubular and a bottomhole assembly (BHA). Drill strings are increasingly used to drill boreholes that have curved, deviated and lateral sections. Typically, such boreholes are drilled using multiple BHAs. For example, vertical and lateral sections of a borehole are drilled using a relatively stiff BHA, and curved sections are drilled by removing the stiff BHA and deploying a flexible BHA.

SUMMARY

An embodiment of a bending stiffness control system in a downhole drilling assembly includes a body configured to be connected to a downhole component of the downhole drilling assembly, the body having a longitudinal axis. The bending stiffness control system also includes a cavity disposed within the body and extending along the longitudinal axis, and a moveable element assembly including one or more moveable elements that are configured to move along the longitudinal axis, the moveable element assembly configured to control a bending stiffness of the body by reacting to a change in an inclination of the body and the longitudinal axis.

An embodiment of a method includes deploying a borehole string in a borehole in a subterranean region, the borehole string including a bending stiffness control system, the bending stiffness control system including a body having a longitudinal axis, the bending stiffness control system including a cavity disposed within the body and extending along the longitudinal axis, and a moveable element assembly including one or more moveable elements that are configured to move along the longitudinal axis. The method also includes controlling an inclination of the body, and controlling a bending stiffness of the body by the moveable element assembly by reacting to a change in the inclination.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
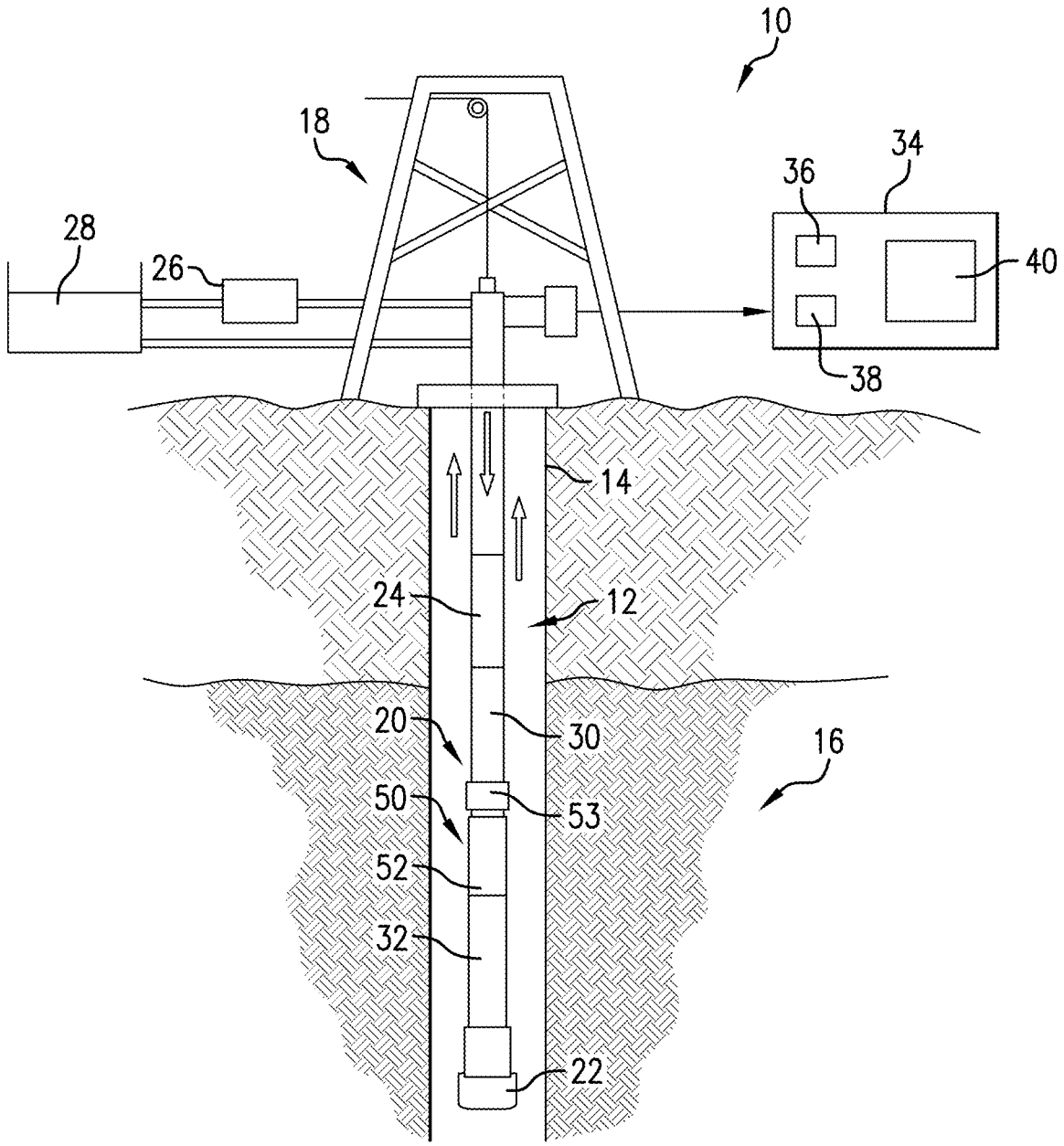
FIG. 1 depicts an embodiment of a drilling and/or formation measurement system including a coupler having a variable bending stiffness.

A detailed description of one or more embodiments of the disclosed apparatus and method are presented herein by way of exemplification and not limitation with reference to the Figures.

Devices, systems and methods are providing for performing subterranean operations (e.g., drilling operations) using one or more components that have a variable bending stiffness. An embodiment of a downhole component includes an automatic bending stiffness control system that is configured to automatically and passively react to changes in inclination, and correspondingly adjust a bending stiffness of the downhole component. In an embodiment, the downhole component is a flexible coupler or collar that has a bending stiffness that can change in response to changes in operating parameters, such as inclination.

The bending stiffness control system includes a cavity defined within a body of the coupler, and a plurality of moveable elements that are free to move within the cavity. The movable elements may be free to move at any inclination, or free to move when the inclination is at a threshold position. The moveable elements may include one or more balls or spheres or one or more annular bodies (e.g., rings or ring segments), or have any other structure that permits movement (e.g., rolling or sliding) along a cavity when the coupler is at an inclined state (i.e., defining a non-zero angle relative to a vertical direction or gravity vector). As the moveable elements automatically react to inclination, the bending stiffness of the downhole component is adjustable without the need for an actuator (mechanical or electronic) or any active control (e.g., commands from an electronic device or operator).

Embodiments described herein provide a number of advantages and technical effects. The systems described herein provide effective mechanisms for adjusting the bending flexibility of a borehole string (also referred to as drilling assembly or drill string) to facilitate drilling boreholes with desired curvatures and inclinations. The systems allow for adjusting bending stiffness as needed to drill both curved and straight (e.g., horizontal or deviated) borehole sections. Furthermore, the systems described herein can automatically adjust bending stiffness in response to downhole conditions without the need for active control or control from the surface, and without complex sensor-based control devices. The bending flexibility control system may also be configured to damp undesirable vibrations (e.g., stick/slip and high frequency oscillations).

Typical drilling operations use a stiff drilling assembly for drilling straight sections, and switch out to a flexible drilling assembly for drilling curved sections, which results in multiple round trips. The embodiments described herein can be used in a drilling operation to drill both curved and lateral sections of a borehole in a single run. The embodiments described herein are capable of allowing the drilling of curves with small radii (e.g., 15 degree/100 feet (ft) change in inclination or azimuth or combinations thereof such as dogleg), and automatically increasing stiffness for drilling horizontal sections with minimal deflections. Accordingly, the embodiments present a more cost-effective solution than existing drilling systems.

FIG. 1 shows an embodiment of a system 10 for performing a subterranean operation (e.g., drilling, measurement, stimulation and/or production). The system 10 includes a borehole string 12 that is shown disposed in a well or borehole 14 that penetrates a subterranean region 16 (including, for example, at least one earth formation).

The borehole string 12 is operably connected to a surface structure or surface equipment 18 such as a drill rig, which includes or is connected to various surface components. In an embodiment, the borehole string 12 is a drill string including one or more drill pipe sections that extend downward into the borehole 14, and is connected to various downhole components, all or some of which may be incorporated in a bottomhole assembly (BHA) 20.

The BHA 20 includes a drill bit 22, which may be driven by the surface equipment 18, e.g., by a surface drive or rotary table, or driven by a downhole mud motor 24. The surface equipment 18 includes components to facilitate circulating fluid such as drilling mud through the borehole string 12 and through an annulus between the borehole string 12 and the wall of the borehole 14. For example, a pumping device 26 is located at the surface to circulate the fluid from a mud pit or other fluid source 28 into the borehole 14 as the drill bit 22 is rotated. The borehole string 12 is discussed as a drill string 12, but is not so limited and can be any type of borehole string (e.g., string for hydraulic fracturing and/or other stimulation, wireline string, wellbore intervention string, fishing string, milling string, etc.)

The system 10 may include one or more of various downhole components configured to perform selected functions downhole such as controlling drilling, controlling drilling direction, performing downhole measurements, facilitating communications, performing stimulation operations and/or performing production operations. For example, the downhole components may include a logging while drilling (LWD) or measurement while drilling (MWD) tool 30, the mud motor 24, a steering or directional control system 32 (e.g., a rotary steerable system), and other components such as a stabilizers and/or vibration damping devices.

Other components may include a telemetry assembly such as a mud pulse telemetry (MPT) assembly, for communicating with the surface and/or other downhole tools or devices. The telemetry assembly includes, for example, a pulser that generates pressure signals through the fluid.

One or more downhole components and/or one or more surface components may be in communication with and/or controlled by a processor such as a downhole processor and/or a processor 38 within a surface processing unit 34. The surface processing unit 34 may control various parameters such as rotary speed, weight-on-bit, fluid flow parameters (e.g., pressure and flow rate) and others. The surface processing unit 34, in one embodiment, includes an input/output (I/O) device 36, the processor 38, and a data storage device 40 (e.g., memory, computer-readable media, etc.).

The system 10 includes at least one component 50 having a variable bending flexibility and stiffness. The component 50 operates to transition between different bending stiffnesses to facilitate drilling along a desired path, and may also be operated or used to dampen undesirable vibrations. That is, during drilling, the component 50 may have a first stiffness at a first time while the component 50 has a first inclination and a second stiffness at a second time while the component 50 has a second inclination. In this example, the first stiffness may be larger than the second stiffness and the first inclination may be lower than the second inclination. The component 50 is described herein as a coupler 50 configured to connect components of the drill string 12. Description of the component 50 as a coupler is not intended to limit the component 50 to any particular type of downhole component or position in the drill string 12.

The coupler 50 includes a coupler body 52 that supports a bending stiffness control system configured to passively adjust the bending stiffness of the coupler 50. The bending flexibility or stiffness is related to an amount of bending exhibited by the coupler 50 in response to lateral forces. The coupler 50 may include additional components such as a stabilizer 53.

Figure 2:
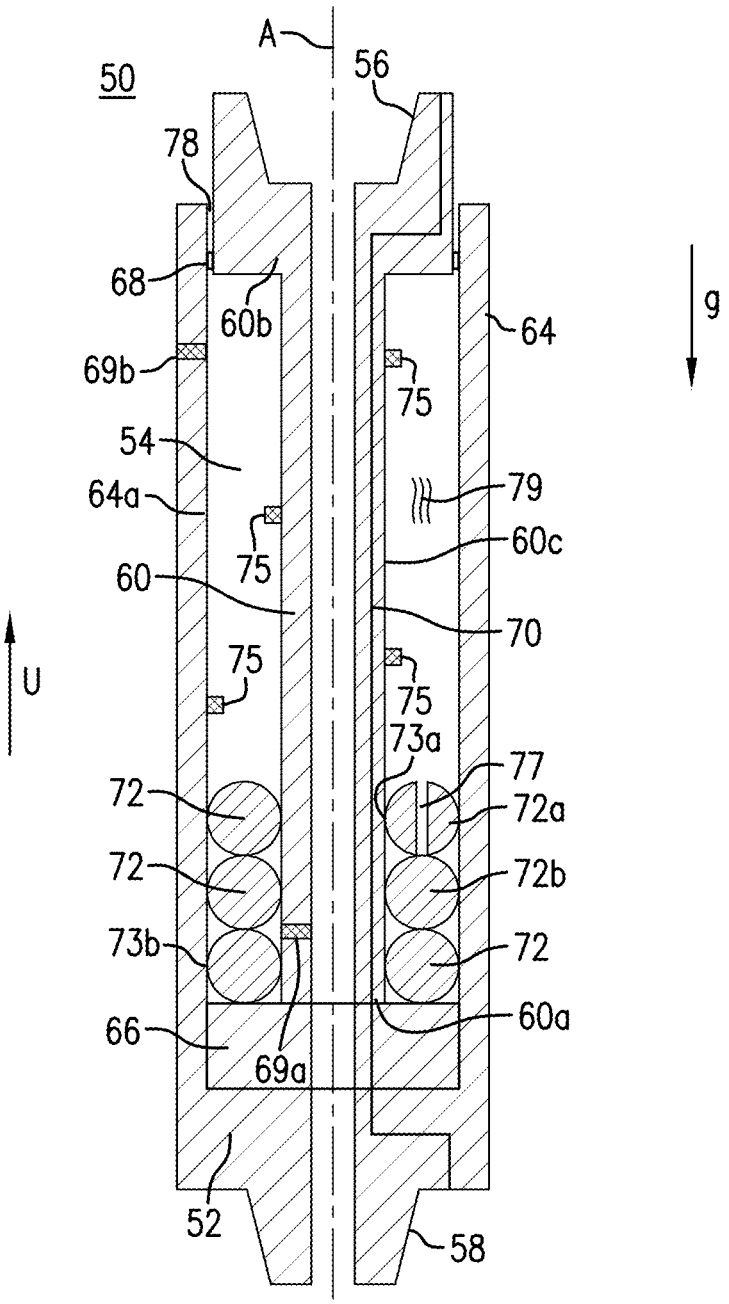
FIG. 2 depicts an embodiment of a coupler having a variable bending stiffness, the coupler including a bending stiffness control system that includes a plurality of axially moveable elements.

FIGS. 2 and 3 depict an embodiment of the coupler 50, which includes a coupler body 52 having a longitudinal axis A. FIG. 2 shows the coupler in a vertical orientation (i.e., at an inclination below a selected threshold inclination, such as below 10° or approximately parallel to a gravity vector g or direction of a gravitational field). FIG. 3 shows the coupler 50 in a horizontal direction (i.e., at an inclination larger than a selected threshold inclination, such as larger than 80° or approximately perpendicular to the gravity vector g or direction of a gravitational field).

During a drilling operation or other subterranean operation, the coupler 50 automatically reacts to changes in inclination of the borehole string 12 and the coupler 50 to adjust bending stiffness. As discussed further herein, when the coupler 50 is vertical (an inclination angle θ relative to a gravity vector g is at least substantially zero) as shown in FIG. 2, the coupler 50 has a first bending stiffness (a minimum bending stiffness). When the coupler 50 is horizontal (the inclination angle θ is at least substantially 90 degrees) as shown in FIG. 3, the coupler 50 has a second bending stiffness (a maximum bending stiffness) that is higher than the first bending stiffness. In an embodiment, the bending stiffness of the coupler 50 is proportional to the inclination angle or otherwise is a function of the inclination angle, so that the coupler 50 can transition to one or more intermediate bending stiffnesses when the inclination angle θ is between zero and 90 degrees. Notably, in one or more embodiments, the first stiffness is changed to the second stiffness in reaction or response to a change of the inclination of the borehole string 12 and or the coupler 50, without using any electronic parts that may consume electrical energy. For example, the component 50 may not include any energy storage device (battery, capacitor, for example), processor, controller, data storage device (memory, buffer, for example), electronic communication device, sensor, actuator, pump, etc. This can be an advantage as controlling systems using this equipment in a harsh downhole environment (i.e., within a borehole penetrating a subterranean formation and while drilling the borehole) may be prone to failure or misfunction.

The coupler 50 can be connected to other components (e.g., the directional control system 32, the LWD or MWD tool 30, etc.) via any suitable connection mechanism. For example, the coupler 50 may include a box connector 56 having internal threading, and a pin connector 58 having external threading, that allow a threaded connection to the directional control system 32, the LWD or MWD tool 30, or other components or parts of borehole string 12.

The coupler body 52 includes or defines a cavity 54 that extends axially in a direction of the longitudinal axis A. In an embodiment, the cavity 54 is defined by a flexible internal support element, referred to as a flexible element 60, that is elongated in the direction of the axis A and mechanically connected to other components or portions of the coupler body 52. The flexible element 60 is configured to carry a drilling load (e.g., weight, bending and torsion) from an uphole connector (e.g., the box connector 56) to a downhole connector (e.g., the pin connector 58). A fluid conduit 62 (e.g., a mud flow bore) may be provided that extends axially through the flexible element 60 and transmits a fluid circulated through the borehole 14, such as a drilling mud.

The coupler body 52 and the flexible element 60 may be formed as a unitary body, or the flexible element 60 may be a separate component attached to the coupler body 52. The coupler 50 and/or components thereof can be manufactured by machining (e.g., milling and turning), casting, additive manufacturing (e.g., 3D printing) and/or other suitable process.

The flexible element 60 may have any desired bending flexibility or bending stiffness. The flexible element 60 may be a steel or aluminum shaft (or a shaft made from any suitable material) that has a flexibility based on material properties of the shaft and geometric properties (e.g., length, thickness and diameter). For example, the flexible element 60 has a bending stiffness that is less than a bending stiffness of other components of the coupler body 52, such as a sleeve 64.

In an embodiment, the flexible element 60 is mechanically connected to the sleeve 64. The flexible element 60 may be coaxial with the sleeve 64, and the cavity 54 is bounded by external surfaces of the flexible element 60 internal surfaces of the sleeve 64, and internal surfaces of other components of the coupler body 52.

For example, the sleeve 64 is mechanically connected to the flexible element 60 by a connecting element 66. The connecting element 66 may be integrally formed with the flexible element 60 and/or the sleeve 64, or may be a separate component that is attached to the flexible element 60 and/or the sleeve 64.

The flexible element 60 may be connected to the sleeve 64, such that one end of flexible element 60 is fixedly attached to the sleeve 64. An opposing end of the flexible element 60 may be fixedly attached or integral with the sleeve 64, or the opposing end may be separate from the sleeve 64 and/or other components of the coupler body 52.

For example, as shown in FIGS. 2 and 3, a first end 60*a* of the flexible element 60 is integral with, or affixed to, the connecting element 66. An opposing second end 60*b* of the flexible element 60 is affixed to the box connector 56 but is separate from the sleeve 64. A gap 78 may be between the second end 60*b* of the flexible element 60 and the sleeve 64 to allow at least some lateral, radial, and/or torsional movement of the flexible element 60 relative to the sleeve 64. In an embodiment, the gap 78 is filled with an elastic material. A seal 68, such as an elastomeric o-ring or other annular body, may be provided in the gap 78 to prevent fluid flow into the cavity 54. Notably, the lateral, radial, and/or torsional movement of the flexible element 60 relative to the sleeve 64 allows the coupler 50 to act as an isolator of vibrations, such as explained and described in US Patent Publication No. 20190284882A1, which is incorporated herein by reference in its entirety. In that respect, the coupler 50 may be used as a vibration isolator that isolates and/or damps vibrations in the BHA 20.

The coupler body 52 may be configured to relay power and/or communications transmitted through a borehole string. For example, the coupler 50 includes an internal bore or conduit 70 for an electrical connection (e.g., wire or cable) or other connection (e.g., fiber optic).

The coupler 50 includes a bending stiffness control system, which is a passive system that automatically reacts to changes in inclination, and adjusts the bending stiffness of the coupler 50.

The bending stiffness control system includes a plurality of moveable elements 72. The moveable elements 72 may be balls or spheres that can roll along the cavity 54, cylinders, bars or annular bodies such as rings or ring segments (which may have a circular, rectangular or other cross-section). The moveable elements can be made up of particles of any shape that transmit bending loads between the flexible element 60 and the sleeve 64 through a multitude of inter-particle contacts. The size, shape, composition and material properties of the moveable elements 72 are not limited to the specific configurations discussed herein.

In an embodiment, there are gaps 73*a* and 73*b* between the moveable elements 72 and the flexible element 60, and between the moveable elements 72 and the sleeve 63, respectively. The gaps 73*a* and 73*b* are preferably relatively small compared to the lateral movement of the flexible element 60 and the sleeve 64 due to bending forces, to ensure contact between the movable elements 72 and both the flexible element 60 and the sleeve 64 when the coupler 50 bends. In an embodiment, the gaps 73 are in the millimeter (mm) range, such as below 10 mm or even smaller (e.g., below 1 mm). One or more of the movable elements 72 may each include an opening 77 to allow fluid 79 to pass for easier movement of the movable element 72 through the fluid 79 in the cavity 54.

Each moveable element 72 is freely moveable along the axial direction. In other words, there is no obstruction or restriction in the cavity 54 that prevents at least some amount of axial movement within the cavity 54. For example, the movable elements 72 may be movable along the axial direction for an axial distance that is equal or greater than the outer diameter of the flexible element 60, or even equal or greater than the outer diameter of the sleeve 64.

In an embodiment, there is a first movable element 72*a* that is movable along the axial direction for a first axial distance, and a second movable element 72*b* that is movable along the axial direction for a second axial distance. In an example, the first and second axial distances may be different, such that first axial distance may be equal to or greater than a multiple of the second axial distance. One or more obstructions 75 may be disposed at one or more locations on an outer surface 60*c* of the flexible element 60 and/or at one or more locations on an inner surface 64*a* of the sleeve 64 to further limit the axial movement of one or more selected movable elements 72, such as the first movable element 72*a* and/or the second movable element 72*b*. The location and number of obstructions is not limited to that shown in FIG. 2, as any number of obstructions 75 may be disposed at any suitable location(s).

Obstructions 75 may be disposed at different angles about the longitudinal axis A of component 50. For example, a first obstruction 75 may be installed at a first angle about the longitudinal axis A of component 50 and a second obstruction 75 may be installed at a second angle about the longitudinal axis A of component 50. First and second angles may be different in this example, such as but not limited to 0° and 180°, 0° and 90°, or 0° and 60° etc. However, obstructions may be located at any other combination of angles about the longitudinal axis A.

Figure 3A:
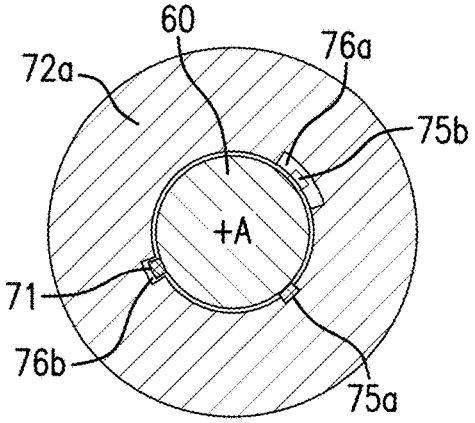
FIGS. 3A and 3B depict an embodiment of the axially moveable elements of FIG. 2, where the axially moveable elements are annular or ring-shaped.
Figure 3B:
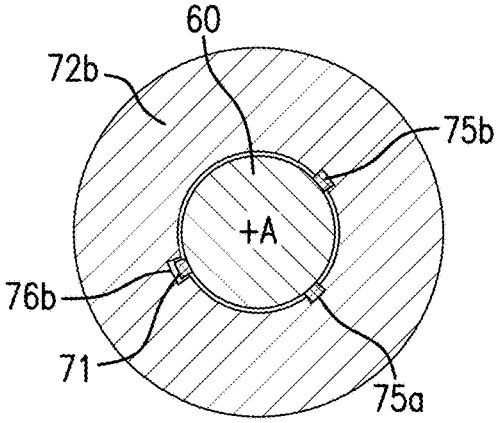

FIGS. 3A and 3B show an embodiment of the movable elements 72*a* and 72*b*, respectively. In this embodiment, the movable elements 72*a* and 72*b* are annular or ring-shaped, and are each disposed about the flexible element 60. The movable elements 72*a* and 72*b* are movable along the longitudinal axis A. One or more guide rails 71 are disposed on and along the flexible element 60, where each guide rail 71 matches to and rides along a corresponding guiding groove 76*b* at a first angle in the movable elements 72*a* and 72*b* to guide the axial movement of the movable elements 72*a* and 72*b*. At the same time, the guide rail 71 prevents or restricts a rotational movement of the movable elements 72*a* and 72*b* about the longitudinal axis A. One or more similar guiding grooves 76*a* may be installed at different angles (i.e., a second angle) in the movable element 72*a*.

One or more obstructions 75*a*, 75*b* may be disposed on the flexible element 60 at different angles about the longitudinal axis A and at different distances or locations along the longitudinal axis A. For example, the obstruction 75*a* may be located at a first axial location and the obstruction 75*b* may be located at a second axial location which is below the first axial location. Thus, the axial movement of the movable element 72*a* is limited by the obstruction 75*a*; however, axial movement of the moveable element 72*a* is not limited by the obstruction 75*b*, as the guiding groove 76*a* (which is at the same angle about the longitudinal axis A as the obstruction 75*b*) allows the moveable element 72*a* to pass by the obstruction 75*b*. Axial movement of the movable element 72*b*, in contrast, is restricted at the obstruction 75*b* at the second axial position. In such an arrangement, the axial movement of each of the movable elements 72*a* and 72*b* may be restricted at a different axial position that is pre-defined by the axial locations of the obstructions 75*a* and 75*b*. In an embodiment, obstructions 75 may be approximately equally spaced along the longitudinal axis A such that the distance between the obstructions 75*a* and 75*b* may be equal or within a tolerance of not more than 50% (for example, within a tolerance of less than 30%). While the obstructions 75*a* and 75*b* are shown as installed on the flexible element 60, those skilled in the art will appreciate that they could also be installed on the inner surface 64*a* of the sleeve 64. In a similar way, the obstructions 75*a* and 75*b* may also be installed on the movable elements 72*a* and 72*b*, while corresponding guide grooves 76*b* and 76*a* are disposed on the flexible element 60 or the sleeve 64 to achieve the same effect. There may be a threshold inclination at which gravitational forces overcome any opposing forces (e.g., frictional forces), i.e., the moveable elements 72 are "freely moveable" when the coupler inclination exceeds the threshold inclination.

Referring again to FIG. 2, in an embodiment, valves or openings are installed in the flexible element 60 and the sleeve 64 to create a flow of drilling fluid through the cavity 54 in an upward direction U to facilitate upward movement of the movable element 72 in the upward direction U. For example, a first opening or valve 69*a* may be installed in the flexible element 60 at a first axial position to connect the fluid conduit 62 with the cavity 54, and a second opening or valve 69*b* may be installed in the sleeve 64 at a second axial position to connect the cavity 54 with drilling fluid in the borehole 14. In such a configuration, the first axial position may be lower (closer to the drill bit 22) than the second axial position to allow flow of drilling fluid through the cavity 54 in the upward direction. One or more of the openings or valves 69*a* and 69*b* may be selectively operable to prevent, allow, or limit the flow of drilling fluid through the cavity 54. In an alternative embodiment, one or more of the openings or valves 69*a* and 69*b* may be sensitive to gravity in a way that they reduce the flow of drilling fluid through the cavity 54 when the coupler 50 is directed more parallel to gravity and/or increase the flow of drilling fluid through the cavity 54 when the coupler 50 is directed more perpendicular to gravity.

In an embodiment, the inner surface of the cavity 54 and/or the moveable elements 72 is/are configured to control the threshold inclination and/or control a rate at which the moveable elements 72 move and separate as a function of inclination. For example, the moveable elements 72, the flexible element 60 and/or the sleeve 64 are made from a material or materials that have a desired surface roughness that can increase friction and resist axial movement. The surface roughness is selected to effect the distribution rate (i.e., the rate at which the moveable elements move, accelerate and/or separate), so that the moveable elements 72 increase the bending stiffness of the coupler body 52 proportional to the inclination or otherwise as a function of the inclination. Alternatively, one or more coatings can be applied to affect the surface roughness.

In other embodiments, the surfaces can be configured to reduce friction. For example, surfaces can be polished or treated with a friction reducing coating.

In an embodiment, the cavity 54 is filled with a fluid 79 (e.g., gas or liquid). In one embodiment, the fluid 79 may be drilling mud. In another embodiment, the fluid 79 may be a gas or liquid that is different from drilling mud, such as silicone oil, for example. The fluid 79 may be pressure compensated, for example, by means of a piston or membrane-based (such as a metal membrane or a rubber bellow) compensation assembly. In addition, the fluid 79 may have properties such as density and viscosity that can affect the distribution rate.

As shown in FIG. 2, when the coupler 50 is approximately vertically orientated (i.e., the inclination of coupler 50 may be at its minimum (e.g., close to or at 0°)), gravity biases the moveable elements 72 toward the bottom or downhole end of the cavity 54. At this point, the coupler 50 has a first stiffness, such as a minimum stiffness, due to the moveable elements accumulating at the bottom of the cavity 54, leaving the flexible element 60 substantially unsupported by the sleeve 64 under bending loads. When the moveable elements 72 are positioned together, the bending moment of the flexible element 60 is decoupled (or weakly coupled) to the bending moment of the sleeve 64 and/or other components of the coupler body 52. As a result, the coupler body 52 has a relatively high bending flexibility (i.e., maximum bending flexibility or minimum bending stiffness).

If the coupler 50 has an inclination that is less than horizontal (a deviated orientation in which the angle θ is between zero and 90 degrees), the effect of gravity on the moveable elements 72 is reduced (the vertical gravitational force component is reduced as the inclination angle θ increases). Drilling dynamics having an increasing effect on the moveable elements and cause the moveable elements to move away from one another.

Figure 4:
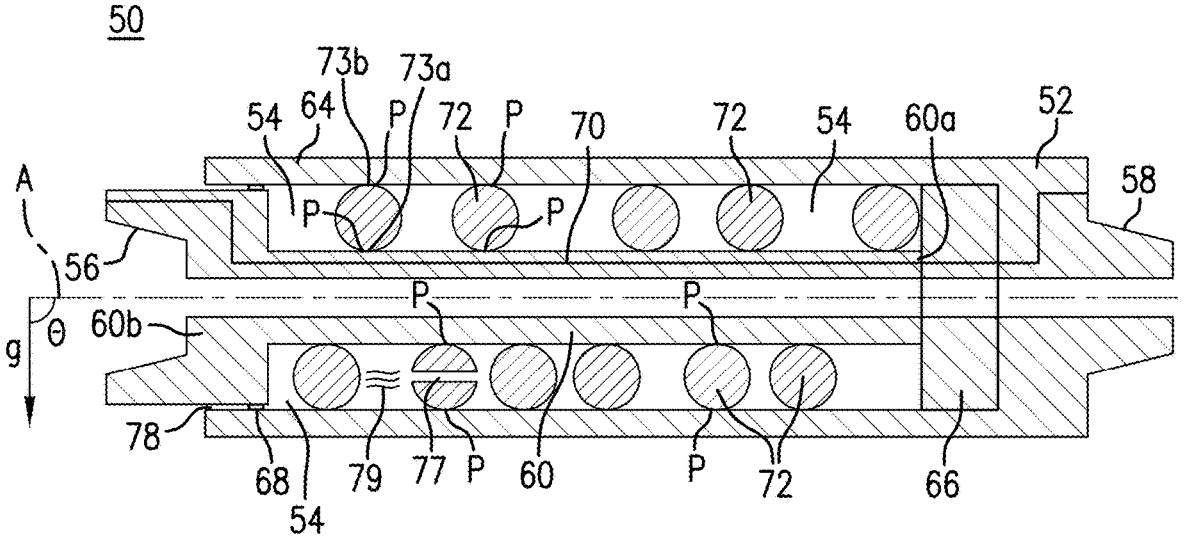
FIG. 4 depicts the coupler of FIG. 2 in a horizontal orientation.
Figure 5:
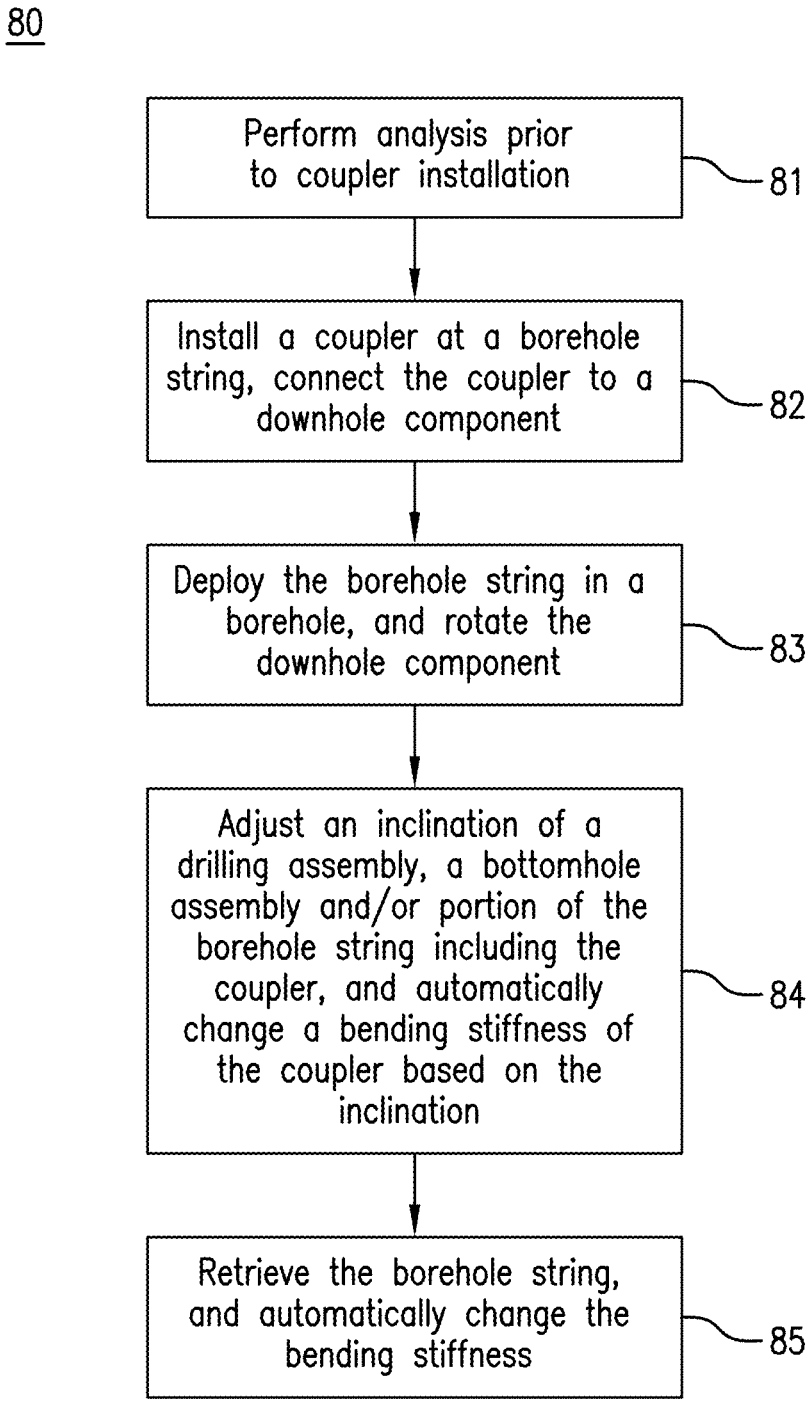
FIG. 5 is a flow diagram depicting an embodiment of a method of performing a subterranean operation, which includes controlling a bending stiffness of a coupler connected to a borehole string.

When the coupler 50 is in a horizontal orientation as shown in FIG. 4, gravity no longer biases the moveable elements toward the downhole end. As the borehole string 12 or components thereof rotate, gravitational forces and drilling dynamics (rotation, vibration, axial movement) and flow of the fluid 79 may cause the moveable elements 72 to separate and distribute along the cavity 54 and the sleeve 64. As a result, the flexible element 60 is supported by the sleeve 64, which causes a second stiffness of the coupler 50 that is significantly larger than the first stiffness because bending loads are transferred at multiple points P along the axis A, and the bending moment of the flexible element 60 is more strongly coupled to the bending moment of the sleeve 64.

For example, as the coupler 50 transitions to the horizontal orientation, the moveable elements 72 gradually separate and increasingly distribute along the cavity 54, and the bending moment of the flexible element 60 becomes more strongly coupled with the bending moment of the sleeve 64. As a result, the bending stiffness increases as the inclination increases. When the coupler 50 is horizontal, the moveable elements 72 have a relatively more even distribution as shown in FIG. 3. In this state, the coupler 50 has a maximum bending stiffness. The resulting stiffer coupler 50 improves the ability to drill straight horizontal sections despite potential deviating forces (e.g., from encountering formation boundaries).

It is noted that the change in bending stiffness is reversable by reducing the inclination toward vertical. For example, when the drilling assembly or BHA 20 is pulled back into a vertical section of the borehole 15, the moveable elements 72 again accumulate at the bottom end, making the coupler 50 more flexible again.

Although the movable elements 72 are shown as having the same or similar size, the bending stiffness control system is not so limited. In the embodiment of FIGS. 2 and 3, each moveable element 72 has the same size such that the moveable elements ride along surfaces of the flexible element 60 and the sleeve 64. However, one or more of the moveable elements 72 may have a different size. For example, the moveable elements 72 may each have a size that is less than the width of the cavity. The moveable elements 72 may also have different sizes, for example, to provide different stiffnesses at different portions of the coupler 50.

It is noted that, although the embodiments are described as having a plurality of moveable elements 72, the embodiments are not so limited. For example, the flexibility control system may have a single moveable element 72, or multiple moveable elements 72 that are connected to one another and move together.

Although the above embodiments feature a single flexibility control system, the embodiments are not so limited. For example, the coupler 50 may include multiple cavities including respective sets of moveable elements 72 (i.e., one or more moveable elements). In addition, any number of couplers 50 may be included in the borehole string 12, for example, by connecting two or more couplers directly to each other, or by distributing multiple couplers along the borehole string.

FIG. 4 illustrates a method 80 of performing a subterranean operation and controlling the bending stiffness of a downhole component or components. The method 80 may be performed in conjunction with the system 10, but is not limited thereto. The method 80 includes steps or stages represented by blocks 81-85. In one embodiment, the method 80 includes the execution of all of the steps or stages in the order described. However, certain steps or stages may be omitted or added, or the order of the steps or stages may be changed.

At block 81, a pre-job analysis may be performed before the coupler 50 and/or the borehole string 12 is fully assembled. During the pre-job analysis, several parameters are taken into account to define axial positions of the coupler 50 in the borehole string 12, the length of the cavity 54, and/or the number of movable elements 72. For example, during the pre-job analysis, a planned well trajectory (that may include planned inclinations, azimuths, curvatures—also referred to as dogleg severities) and a planned borehole string (including the axial position of one or more couplers 50 in the borehole string, a length of the cavity 54, and/or a number of movable elements 72) may be considered to calculate (for example, by numerical simulations) or estimate expected parameters such as expected bending forces acting on portions of the borehole string 12, and/or expected vibration levels that may occur at portions of the borehole string 12.

An iterative process may be performed, which includes assuming a first axial position of the coupler 50 in the borehole string, a first assumed length of the coupler 50 and/or a first assumed number of movable elements 72. Expected parameters are calculated based on the first axial position of the coupler 50 in the borehole string, the first assumed length of the coupler 50 and/or the first assumed number of movable elements 72. If the expected parameters are not in an acceptable range, a second axial position of the coupler 50 in the borehole string, a second assumed length of the coupler 50 and/or a second assumed number of movable elements 72 may be assumed to re-calculate the expected parameters. This process may continue until the expected parameters are in an acceptable range, and the axial position of the coupler 50 in the borehole string, the length of the cavity 54, and/or the number of movable elements 72 may be selected based on these calculations. For example, various couplers 50 may be preconfigured with different cavity lengths and/or different numbers of movable elements 72. The length of the cavity 54 and/or the number of movable elements 72 may be selected by selecting one of the preconfigured couplers. The coupler 50 may be then assembled and installed in the borehole string 12 with one or more of the selected axial position of the coupler 50 in the borehole string 12, the selected length 54, and/or the selected number of movable elements 72.

At block 82, a coupler 50 is installed at a borehole string, such as the drill string 12. For example, the coupler 50 is connected at one end to a downhole component (e.g., the LWD or MWD tool 30 or the stabilizer 53) and connected at another end to another downhole component (e.g., the direction control system 32). Any number of couplers 50 may be installed at any number of locations and connected to any desired components.

At block 83, drilling is initiated by rotating a drilling assembly, and a vertical section of a borehole is drilled. In the vertical orientation, the moveable elements 72 are accumulated at the downhole end of the cavity and the coupler 50 has a minimum stiffness.

At block 84, an inclination of the drilling assembly, BHA 20 and/or a portion of the borehole string including the coupler 12 is adjusted, and the bending stiffness control system automatically changes a bending stiffness of the coupler 50 based on the inclination.

For example, the drilling assembly is steered (e.g., via the directional control system 32), and the drilling assembly and the coupler 50 deviate from vertical. The moveable elements 72 may begin to move and separate, or begin to move and separate when the coupler 50 reaches a threshold inclination.

As the inclination increases, the moveable elements 72 separate more and more, and the bending stiffness increases gradually or otherwise as a function of the inclination. Upon reaching the horizontal orientation (or after some period of time during which the moveable members continue to distribute), the moveable members 72 are distributed along the cavity and the coupler 50 has a maximum bending stiffness.

At block 85, after drilling a desired length, the borehole string 12 may be retrieved or tripped out to the surface. When the coupler 50 returns to the vertical orientation, the moveable members 72 again collect at the downhole end, and the bending stiffness returns to the maximum stiffness.

The coupler 50 may be used to dampen torsional and/or lateral vibrations. An example of such a damping system that is configured to dampen vibrations by movable elements are described, for example, in US Patent Publication 20210079976 and U.S. Pat. No. 11,199,242, assigned to the applicant, which are incorporated herein by reference in their entirety. For example, as the coupler 50 rotates, frictional forces arise due to differential rotation of the moveable elements 72 and the coupler body 52. Such frictional can counteract torsional vibrations, thereby providing torsional damping. If the cavity 54 is filled with fluid 79, the fluid 79 may provide torsional damping, and may also exhibit a damping effect to counteract lateral vibrations.

Set forth below are some embodiments of the foregoing disclosure:

Embodiment 1: A bending stiffness control system in a downhole drilling assembly, comprising: a body configured to be connected to a downhole component of the downhole drilling assembly, the body having a longitudinal axis; a cavity disposed within the body and extending along the longitudinal axis; and a moveable element assembly including one or more moveable elements that are configured to move along the longitudinal axis, the moveable element assembly configured to control a bending stiffness of the body by reacting to a change in an inclination of the body and the longitudinal axis.

Embodiment 2: The bending stiffness control system of any prior embodiment, wherein the one or more moveable elements are moveable to distribute along the cavity when the inclination exceeds a threshold inclination.

Embodiment 3: The bending stiffness control system of any prior embodiment, wherein at least one of an inner surface of the cavity and a surface of each of the plurality of moveable elements has a surface roughness selected to control at least one of: the threshold inclination, and a distribution rate of the moveable element assembly.

Embodiment 4: The bending stiffness control system of any prior embodiment, wherein the one or more moveable elements include at least one of: a ball configured to roll along the cavity, and an element configured to slide along the cavity.

Embodiment 5: The bending stiffness control system of any prior embodiment, wherein the moveable element assembly is configured to control the bending stiffness based on a distribution of the one or more moveable elements along the cavity.

Embodiment 6: The bending stiffness control system of any prior embodiment, wherein the one or more moveable elements comprise a first moveable element and a second moveable element and the bending stiffness control system further comprising an obstruction in the cavity, wherein the obstruction is configured to limit the movement of the first moveable element along the longitudinal axis but not the movement of the second moveable element along the longitudinal axis.

Embodiment 7: The bending stiffness control system of any prior embodiment, wherein the moveable element assembly is configured to transition between a first state in which the body has a minimum bending stiffness and a second state in which the body has a maximum bending stiffness.

Embodiment 8: The bending stiffness control system of any prior embodiment, wherein the bending stiffness control system is in the second state based on the body having at least one of: a horizontal orientation, and an inclination that is larger than a selected threshold inclination.

Embodiment 9: The bending stiffness control system of any prior embodiment, wherein the bending stiffness control system is in the first state based on the body having at least one of: a vertical orientation, and an inclination that is less than a selected threshold inclination.

Embodiment 10: The bending stiffness control system of any prior embodiment, wherein the bending stiffness control system is configured to adjust the bending stiffness to one or more intermediate bending stiffnesses as a function of the inclination.

Embodiment 11: A method comprising: deploying a borehole string in a borehole in a subterranean region, the borehole string including a bending stiffness control system, the bending stiffness control system including a body having a longitudinal axis, the bending stiffness control system including a cavity disposed within the body and extending along the longitudinal axis, and a moveable element assembly including one or more moveable elements that are configured to move along the longitudinal axis; controlling an inclination of the body; and controlling a bending stiffness of the body by the moveable element assembly by reacting to a change in the inclination.

Embodiment 12: The method of any prior embodiment, wherein the one or more moveable elements are moveable to distribute along the cavity when the inclination exceeds a threshold inclination.

Embodiment 13: The method of any prior embodiment, wherein at least one of an inner surface of the cavity and a surface of each of the one or more moveable elements has a surface roughness selected to control at least one of: the threshold inclination, and a distribution rate of the moveable element assembly.

Embodiment 14: The method of any prior embodiment, wherein the one or more moveable elements include at least one of: a ball configured to roll along the cavity, and an element configured to slide along the cavity.

Embodiment 15: The method of any prior embodiment, wherein controlling the bending stiffness includes controlling a distribution of the one or more moveable elements along the cavity based on the inclination.

Embodiment 16: The method of any prior embodiment, wherein controlling the bending stiffness further includes selecting at least one of: an axial position of the bending stiffness control system in the borehole string, a length of the cavity, and a number of the one or more moveable elements before the deploying the borehole string in the borehole.

Embodiment 17: The method of any prior embodiment, wherein controlling the bending stiffness includes transitioning between a first state in which the body has a minimum bending stiffness and a second state in which the body has a maximum bending stiffness.

Embodiment 18: The method of any prior embodiment, wherein the body is in the first state based on the body having at least one of: a horizontal orientation, and an inclination that is larger than a selected threshold inclination.

Embodiment 19: The method of any prior embodiment, wherein the body is in the second state based on the body having at least one of: a vertical orientation, and an inclination that is less than a selected threshold inclination.

Embodiment 20: The method of any prior embodiment, wherein controlling the bending stiffness includes orienting the bending stiffness control system to an intermediate inclination between the vertical orientation and the horizontal orientation, the intermediate inclination causing the bending stiffness to be between the maximum bending stiffness and the minimum bending stiffness.

In connection with the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of #8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A bending stiffness control system in a downhole drilling assembly, comprising:

a body configured to be connected to a downhole component of the downhole drilling assembly, the body having a longitudinal axis;

a cavity disposed within the body and extending along the longitudinal axis; and a moveable element assembly including one or more moveable elements that are configured to move along the longitudinal axis, the moveable element assembly configured to control a bending stiffness of the body by reacting to a change in an inclination of the body and the longitudinal axis, wherein the one or more moveable elements are freely movable when the inclination of the body is higher than a threshold inclination.

2. The bending stiffness control system of claim 1, wherein the one or more moveable elements are freely moveable to distribute along the cavity when the inclination exceeds the threshold inclination.

3. The bending stiffness control system of claim 2, wherein at least one of an inner surface of the cavity and a surface of each of the plurality of moveable elements has a surface roughness selected to control at least one of: the threshold inclination, and a distribution rate of the moveable element assembly.

4. The bending stiffness control system of claim 1, wherein the one or more moveable elements include at least one of: a ball configured to roll along the cavity, and an element configured to slide along the cavity.

5. The bending stiffness control system of claim 1, wherein the moveable element assembly is configured to control the bending stiffness based on a distribution of the one or more moveable elements along the cavity.

6. The bending stiffness control system of claim 1, wherein the one or more moveable elements comprise a first moveable element and a second moveable element and the bending stiffness control system further-comprising comprises an obstruction in the cavity, wherein the obstruction is configured to limit the movement of the first moveable element along the longitudinal axis but not the movement of the second moveable element along the longitudinal axis.

7. The bending stiffness control system of claim 1, wherein the moveable element assembly is configured to transition between a first state in which the body has a minimum bending stiffness and a second state in which the body has a maximum bending stiffness.

8. The bending stiffness control system of claim 7, wherein the bending stiffness control system is in the second state based on the body having at least one of: a horizontal orientation, and an inclination that is larger than a selected threshold inclination.

9. The bending stiffness control system of claim 7, wherein the bending stiffness control system is in the first state based on the body having at least one of: a vertical orientation, and an inclination that is less than a selected threshold inclination.

10. The bending stiffness control system of claim 9, wherein the bending stiffness control system is configured to adjust the bending stiffness to one or more intermediate bending stiffnesses as a function of the inclination.

11. A method comprising:

deploying a borehole string in a borehole in a subterranean region, the borehole string including a bending stiffness control system, the bending stiffness control system including a body having a longitudinal axis, the bending stiffness control system including a cavity disposed within the body and extending along the longitudinal axis, and a moveable element assembly including one or more moveable elements that are configured to move along the longitudinal axis, wherein the one or more moveable elements are freely movable when the inclination of the body is higher than a threshold inclination;

controlling an inclination of the body; and controlling a bending stiffness of the body by the moveable element assembly by reacting to a change in the inclination.

12. The method of claim 11, wherein the one or more moveable elements are freely moveable to distribute along the cavity when the inclination exceeds the threshold inclination.

13. The method of claim 12, wherein at least one of an inner surface of the cavity and a surface of each of the one or more moveable elements has a surface roughness selected to control at least one of: the threshold inclination, and a distribution rate of the moveable element assembly.

14. The method of claim 11, wherein the one or more moveable elements include at least one of: a ball configured to roll along the cavity, and an element configured to slide along the cavity.

15. The method of claim 11, wherein controlling the bending stiffness includes controlling a distribution of the one or more moveable elements along the cavity based on the inclination.

16. The method of claim 11, wherein controlling the bending stiffness further includes selecting at least one of: an axial position of the bending stiffness control system in the borehole string, a length of the cavity, and a number of the one or more moveable elements before the deploying the borehole string in the borehole.

17. The method of claim 11, wherein controlling the bending stiffness includes transitioning between a first state in which the body has a minimum bending stiffness and a second state in which the body has a maximum bending stiffness.

18. The method of claim 17, wherein the body is in the first state based on the body having at least one of: a horizontal orientation, and an inclination that is larger than a selected threshold inclination.

19. The method of claim 17, wherein the body is in the second state based on the body having at least one of: a vertical orientation, and an inclination that is less than a selected threshold inclination.

20. The method of claim 19, wherein controlling the bending stiffness includes orienting the bending stiffness control system to an intermediate inclination between the vertical orientation and the horizontal orientation, the intermediate inclination causing the bending stiffness to be between the maximum bending stiffness and the minimum bending stiffness.

* * * * *